US005573137A

United States Patent [19]

Pauls

[11] Patent Number: 5,573,137

[45] Date of Patent: Nov. 12, 1996

[54] PRESSURIZED CAN FOR FOAM EXPLUSION

[75] Inventor: Mathias Pauls, Appenzell, Switzerland

[73] Assignee: Rathor AG, Appenzell, Switzerland

[21] Appl. No.: 347,113

[22] Filed: Nov. 23, 1994

[30] Foreign Application Priority Data

Nov. 25, 1993 [EP] European Pat. Off. ..... 93118963

[51] Int. Cl.[6] ..... B65D 83/14

[52] U.S. Cl. ..... 222/80; 222/129; 222/190; 222/389; 222/402.1

[58] Field of Search ..... 222/80, 145.1, 222/129, 190, 387, 389, 402.1

[56] References Cited

U.S. PATENT DOCUMENTS

| | | | |
|---|---|---|---|
| 2,925,937 | 2/1960 | Schmidt et al. | 222/389 X |
| 3,216,463 | 11/1965 | Kibbel, Jr. et al. | 222/389 X |
| 3,362,589 | 1/1968 | Kinnavy et al. . | |
| 3,381,863 | 5/1968 | Towns | 222/389 X |
| 3,613,961 | 10/1971 | Morane et al. | 222/389 |
| 3,727,797 | 4/1973 | Cronan | 222/80 |
| 4,023,717 | 5/1977 | Schultz | 222/389 X |
| 4,355,736 | 10/1982 | Schumacker et al. | 222/80 |
| 4,385,714 | 5/1983 | Szabo et al. | 222/80 |
| 4,508,244 | 4/1985 | Plaschka et al. | 222/153 |

FOREIGN PATENT DOCUMENTS

| | | | |
|---|---|---|---|
| 3733522 | 7/1989 | Germany | 222/80 |
| 3-148481 | 6/1991 | Japan | 222/80 |
| 3-148482 | 6/1991 | Japan | 222/80 |
| 3-162273 | 7/1991 | Japan | 222/80 |
| 2015655 | 9/1979 | United Kingdom . | |

*Primary Examiner*—Andres Kashnikow
*Assistant Examiner*—Kenneth Bomberg
*Attorney, Agent, or Firm*—McDermott, Will & Emery

[57] ABSTRACT

A pressurized can for the expulsion of building foams such as single-component polyurethane foams, the body of which is a cylinder, with a preferably pushed-in bottom. The body also includes a dome-like top section with a valve which expels the can contents consisting of a product component and a propellant. A floating plunger mounted on the interior wall of the cylinder separates the propellant gas chamber from the product component. The floating plunger has a cavity in its upper side, in which a component reactive with the product component is sealed off from the product component by a seal. A trigger device is placed in the dome-like top section to open the seal when the plunger reaches a position immediately below the dome-like top section.

16 Claims, 2 Drawing Sheets

PRESSURIZED CAN FOR FOAM EXPLUSION

BACKGROUND OF THE INVENTION

1. Field of the Invention

The invention concerns a pressurized can, the body of which is a cylinder, with a preferably pushed-in bottom, a dome-like top section with a valve to expel the can contents consisting of product component and propellant, and which has a floating plunger mounted on the interior wall of the cylinder, which separates the propellant gas chamber from the product component and which has a cavity in its upper side. The pressurized can is particularly suited for the expulsion of building foams, for instance single-component polyurethane foams, such as those commonly used for construction and sealing purposes.

2. Description of the Related Art

Such pressurized cans are used to expel different products. These include sealants on a rubber, oil, butyl, silicon and acrylate basis, but especially foaming agents based on polyisocyanate prepolymers. On contact with water (humidity), such polyisocyanate prepolymers turn into polyurethane foams which are used for sealing, filling, insulation, adhesion and fastening, especially in the construction industry. The pressurized cans to expel such foaming agents on a polyisocyanate basis are usually made of sheet steel, because of the great interior pressure among other reasons, and special valves are used to facilitate the handling of the can contents.

Pressurized cans of this type are known, for instance, from U.S. Pat. No. 3,362,589. When used for the production of polyurethane foams, such pressurized cans contain a filling consisting of, for example, 60% by weight polyurethane prepolymers, and about 40% by weight propellant gas. The greater part of the propellant gas is used as a transporting agent, to expel the prepolymer from the pressurized can. Only a small portion of the propellant gas, about 10%, turns into a foaming agent and supports expansion.

If the can is stored for a longer period of time, the component substances usually separate, in which case the specifically heavier propellant settles on the bottom of the pressurized can. Before use, it is advisable to shake the can forcefully and for a long time to achieve the intensive mixture of foaming agent and propellant. Insofar as the gas works as a propellant and comes out of the pressurized can with the foaming agent, it escapes into the atmosphere under expansion.

EP-A 0 078 936 describes a pressurized can for the expulsion of building foams, the body of which is a cylinder, with a preferably pushed-in bottom and a dome-like top section with a seal. A valve for expelling the can contents consisting of a propellant and foaming agent is placed in the dome-like top section. A floating plunger is mounted on the interior wall of the body cylinder between the propellant and the foaming agent contained in different chambers of the can which separates the lower propellant gas chamber from the chamber above it which contains the foaming agent. As the can empties, the plunger moves up within the can, stopping against the dome-like top section of the pressurized can when finally empty. To ensure thorough emptying, the top of the plunger is shaped to fit the curvature of the can dome, and has a cavity in the area where the valve disk reaches down into the inside of the can. According to EP-A 0 078 936, the plunger is fitted into the can cylinder in such a way that propellant can pass between the wall of the can and the pressurized can from the propellant chamber into the foaming agent chamber, but the foaming agent essentially remains in its upper chamber.

Pressurized cans of the type described in EP-A 0 078 936 have proven themselves very well in practice. They make it possible to use up the foaming agent to a great extent, so that only very small quantities of foaming agent remain when the can is fully empty. These small quantities fall within the range of about 5% of the original can contents. The disadvantage, however, is that the polyisocyanate prepolymers used as foaming agent[s] are highly reactive and toxic. For this reason, even empty pressurized cans cannot be disposed of easily, but require special handling pursuant to the regulations applicable to such residues. This leads to considerable drawbacks and costs. The same applies to a number of other products which are sold in cans and which are highly reactive and/or toxic.

SUMMARY OF THE INVENTION

The goal of the invention, therefore, is to produce a pressurized can in which the product components remaining after use and when the can is basically empty, in particular polyisocyanate prepolymers, can be converted into environmentally harmless or tolerable byproducts. The conversion should automatically occur when the pressurized can has already yielded the expellable portion of its contents.

This goal is met with a pressurized can of the type described in the beginning, in which the cavity contains a component reactive with the product component that is sealed off from the product component. A trigger device is placed in the interior of the dome-like top section, which breaks the seal when the plunger reaches a position immediately below the dome-like top section or strikes up against it.

Under the invention, therefore, the trigger device installed in the dome-like top section breaks the seal when the floating plunger installed in the pressurized can strikes up against it, such that the reactive component, hermetically sealed off in the cavity from the product component until the moment of detonation or penetration is released and caused to react with the product component. This reaction converts the product component into harmless byproducts which may be disposed of easily. It is especially advantageous that the conversion occurs automatically when the pressurized can has yielded the expellable portion of its contents, containing only the remaining and not expellable residual contents. The reactive component is released automatically without any action by the person using the can.

To suit the desired purpose, the trigger device should preferably be a spike, mounted, for example, on the underside of the valve disk. The cavity in the upper side of the plunger is designed so that it can interact with the trigger device, in particular the spike. If the spike is placed on the underside of the valve disk, a cavity in the center of the top side of the plunger would suit the purpose.

The seal protecting the cavity against the product component can be made of any material and can take any form, as long as the interaction with the trigger device leads it to be opened or broken. It would suit the purposes for the seal to be a foil, made of, for example, polyethylene, polypropylene or aluminum. Other suitable materials can be used for such foils. It must be kept in mind that if the reactive component is a low-molecular substance, like water, for example, polyethylene and polypropylene cannot ensure a complete seal, since water diffuses through these substances. In this case, it would suit the purposes to use an aluminum foil. If the plunger is not made out of metal, but out of polyethylene or polypropylene, the cavity should be lined with an aluminum foil, especially if water is to be used as the reactive component, in which case the sealing foil should be connected to the lining foil in the form of a pouch or can.

The reactive component contained in the cavity in the top of the plunger should be available in such a quantity to ensure that the volume product component remaining in the pressurized can after the plunger strikes up against the dome-like top section can be fully converted into environmentally and/or toxicologically harmless byproducts. The quantities required for this purpose are quite small, and lie in the range of 0.5 to 1 gram of water for a pressurized can for the production of polyurethane foam made from polyisocyanates, with a filling volume of 750 ml and an expulsion rate of 95%.

As reactive components for product components that harden on contact with moisture, OH-reactive substances in particular may be considered, for instance water, already mentioned, but also monovalent, low molecular weight alcohols such as ethanol, polyvalent alcohols such as ethylene glycol or propylene glycol or glycerine, or low molecular weight carbonic acids, such as ethanoic acid or propanoic acid, as well as mixtures of these substances with water and/or with each other. NH-reactive substances could also be used, preferably monovalent or polyvalent primary or secondary amines. With these substances, it is necessary to apply stoichiometric or slightly excess quantities to the residual product component, to ensure complete conversion of the product component.

Alternatively, catalytically active substances may be used as the reactive component, such as those, for instance, that initiate the polymerization of the reactive component. Such agents are, for instance, metal alkanoates, such as sodium octoate or potassium octoate. Catalytically active substances can also be used to increase the reactivity of OH-reactive substances, in the form of tertiary amines, for instance.

It is especially useful to use water and/or a polyvalent alcohol as the reactive component in the case of a commonly sold prepolymer based on isocyanates, in which case a catalytic substance such as triethylene diamine can be added to accelerate the reaction. Other known reaction accelerants may be used. But a pirk catalyzer can also be considered for the reactive component, which would bring about the radical polymerization of the remaining isocyanate, converting it into tolerable byproducts.

The pressurized cans according to the invention are filled with the usual product component and propellants. The reactive component is formed by substances which are capable of reacting with these product components, and which are chosen with the latter in mind, and which are known in themselves. The pressurized cans used for the invention are also like previous cans in terms of their form and the expulsion technique, aside from the presence of the trigger device and the special shape of the plunger with its reactive component sealed off from the interior of the can.

Details of the invention are found in the following description of a form of execution based on the attached diagrams.

DETAILED DESCRIPTION OF THE INVENTION

Figure 1:
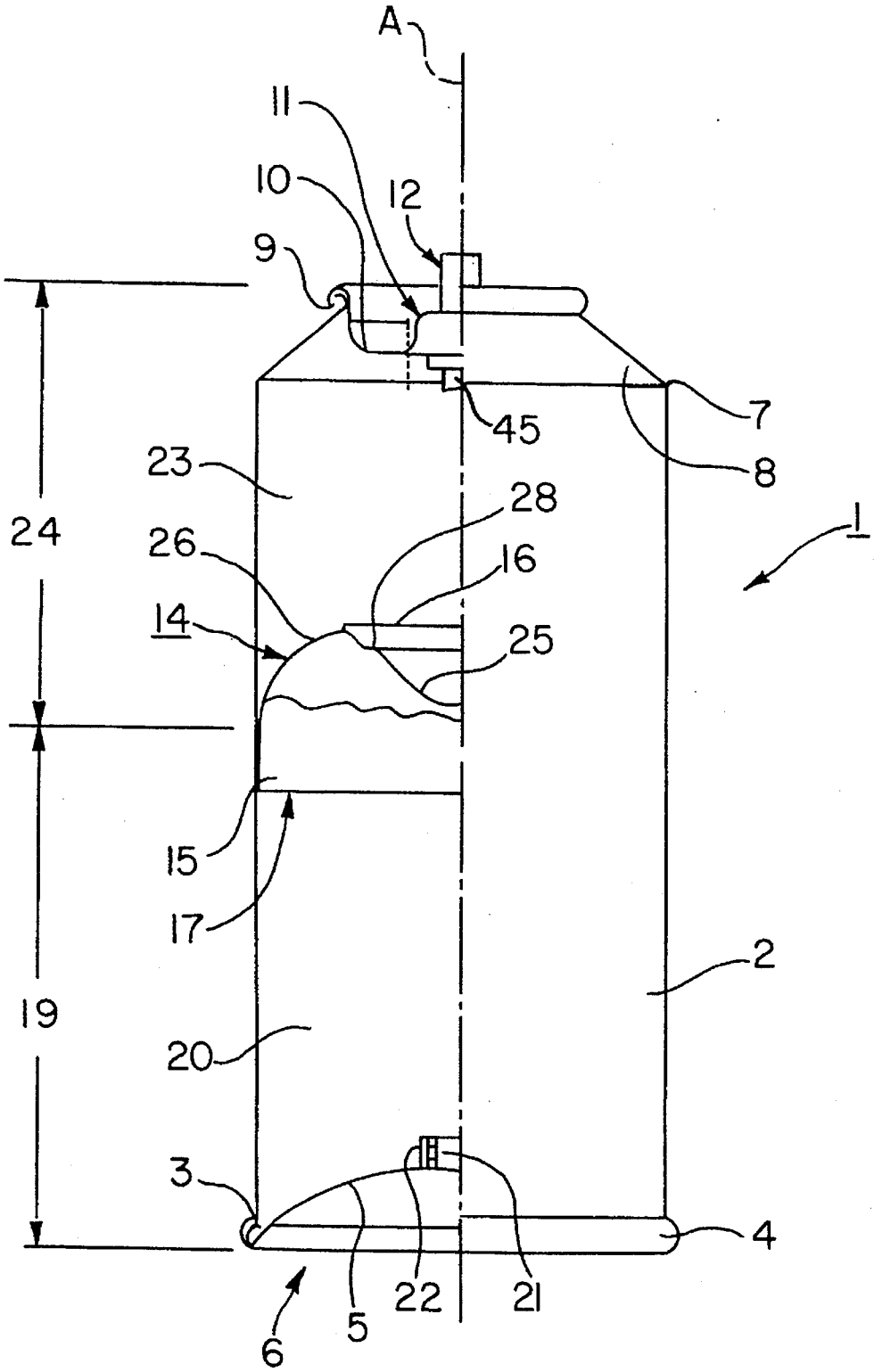
FIG. 1 shows, schematically and under omission of all details which are not necessary for an understanding of the invention, a pressurized can according to the invention, partially in cross-section.
Figure 2:
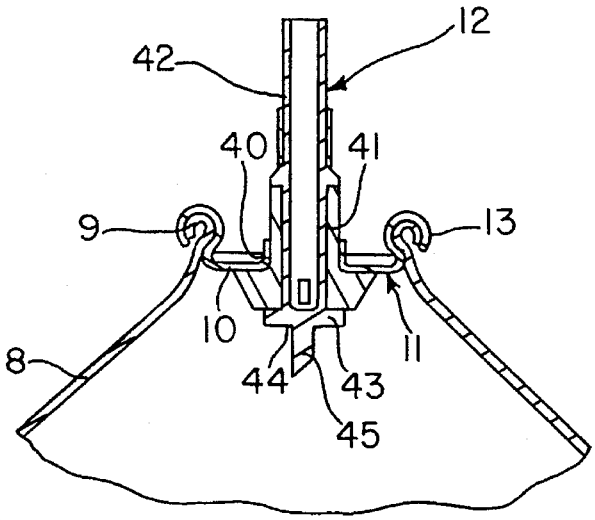
FIG. 2 shows the upper end of the pressurized can in cross-section and enlarged.

The pressurized can shown in FIGS. 1 and 2, has a body marked 1, which is made of steel sheet in the illustrated execution example. The central part consists of a cylinder 2, whose lower rim at 3 is flanged with the rim 4 of a bottom 6 pushed in at 5. The upper rim 7 of the cylinder 2 runs into a dome-like top section 8, i.e. in the form of a truncated cone, the rim 9 of which top section, encircling a central opening, has a closure mechanism 11. The closure mechanism has a disk 10, whose rim 13 is wrapped around the rim 9. The disk 10 has a central opening 40, in which a plug-like rubber seal 41 of a valve 12 is set. The valve body 42 is tube-shaped and is closed at its interior end with a valve disk 43, which lies pressed against the rubber seal under the influence of the interior pressure. Under the valve disk 43 and within the tube sealed on the outside are one or several openings 44, through which the can contents escape when the valve body 42 is tilted, thus disengaging the valve disk 43. On the underside of the valve disk 43 is a spike 45, which protrudes perpendicularly into the interior chamber of the pressurized can.

A floating plunger 14 is mounted in the cylinder 2. The plunger shirting 15 runs along the cylinder wall, but the plunger has enough mobility in the can to move without sticking in the direction of can axis A. The plunger is mounted in the cylinder in such a way that propellant can pass between the plunger shirting 15 and the inner wall of the cylinder 2, from the lower can area to the upper can area. It is also possible to have a seal between the plunger shirting 15 and the inner wall of the can cylinder 2, or to set the distance between the plunger shirting and the cylinder wall in such a way that a film seal is formed in this interstice by the entry of product component.

In rest position, the plunger floats on the propellant gas filling, with the product component above it. When the valve is activated, liquid propellant gas vaporizes out of the filling, driving the plunger along with the product component upwards in the direction of the valve.

The plunger 14, thus located between propellant gas filling and product component filling, defines a variable lower length 19 of the cylinder 2. The circumference 19 of the cylinder thereby surrounds a chamber 20, which is filled with propellant and is closed at the bottom by the can base 6 and at the top by the underside 17 of the plunger 14. The propellant is filled (or injected) with the aid of a filling needle (not shown) through a radial opening 21 of a valve in the can base, and a rubber valve ring 22 placed around the valve.

The plunger 14 floats on the propellant filling of the propellant gas chamber 20; the liquid product component is located in chamber 23 above the plunger top 26. The chamber is surrounded by the remaining length 24 of the cylinder 2, the dome 8 and the closure mechanism 11.

In the execution example illustrated here, the plunger top 26 has a cavity 25 in the side turned toward chamber 23, and has an outer surface in the shape of a truncated cone, bulging outward, i.e. convex. Parts of the convex surface 26 can strike from within against the dome-like top section or against the closure mechanism, as soon as the plunger 14 has reached its upper end position. The spike 45 on the underside of the valve disk 43 then penetrates the cavity 25. The spike can have the form of a sharp-pointed needle, but also any other form suitable for bursting the seal 16 can be used.

The cavity 25 in the plunger top 26 has a sealing foil 16, either glued on or soldered on, which can be attached either on the upper side of the plunger top 26 or onto a ledge 28 encircling the cavity 25 (illustrated here in the first case). The reactive component is located in the chamber 18 defined by the cavity 25 and the foil 16, and is released when, after full expulsion of the filling through the valve, the plunger 14, reaching the upper end position, protrudes into the dome 8 and presses the foil 16 against the spike 45, which causes it to rip.

The reactive component in chamber 18 is introduced into the plunger when it is produced, and placed into the pressurized can along with the plunger.

When filling the can, the product component is first introduced into the can while still open, using a certain amount of propellant gas if it is a foaming agent. After flanging the rim of the disk 10 around the rim 9, the can is closed. After filling the foaming agent, the propellant is placed into the lower can area with the aid of a filling needle inserted through the opening 21 and the rubber valve ring 22. Once the necessary pressure has been achieved in the propellant gas chamber 20, the filling needle is removed, after which the one-way valve shuts itself automatically under the pressure of the propellant gas. Then, the can is ready for use.

When executing the pressurized can for the expulsion of building foam according to the invention, it is advisable that propellant gas can pass into the filling (or chamber) 23 through the space between the plunger shirting 15 and the cylinder wall 2, to make available a portion of the gas for expansion. However, by properly fitting the plunger shirting to the inner cylinder wall, the liquid filling from the chamber 23 cannot penetrate into the propellant gas chamber 20, regardless of the can's position.

Such a pressurized can for building foam is activated by tilting the valve 12 with the valve disk 43. Once the valve is opened by tilting the valve disk 43, foaming agent comes out and the plunger 14 moves upward. In FIG. 1, the position of the plunger indicates that the can is about half empty. As soon as the valve 12 is closed, the plunger 14 remains in its current position, moving upwards again when the valve is opened.

Finally, the plunger reaches its upper end position, in which it strikes up against the dome 8, or the foil 16 strikes against the spike 45. The reactive component escapes from the chamber 18. Now, the propellant gas bearing the remaining foaming agent also distributes the reactive component in the now very small, almost closed chamber 23, allowing for a reaction of the remaining foaming agent with the reactive component which converts the former into non-toxic byproducts. These byproducts remain in the can and are disposed of along with the can. Disposal can be through the usual landfills or incinerators if the propellant gas volume is measured in such a way that no or only very small residues remain in the pressurized can.

Figure 3A:
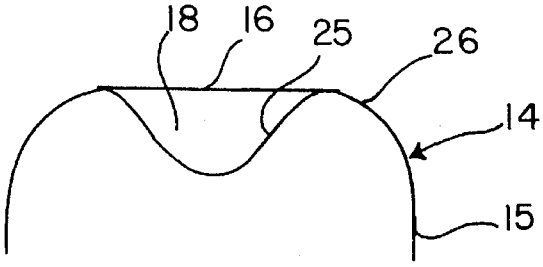
FIG. 3 shows individual illustrations a through c of the plunger used in the invention, in cross-section.

FIG. 3 shows useful execution forms in cross-section of the plunger used in the pressurized can according to the invention. The plunger according to FIG. 3*a* shows a foil 16 glued or soldered onto the plunger top 16 above the circular cavity 25. The reactive component is located in the chamber 18 defined by the foil 16 and the cavity 25.

Figure 3B:
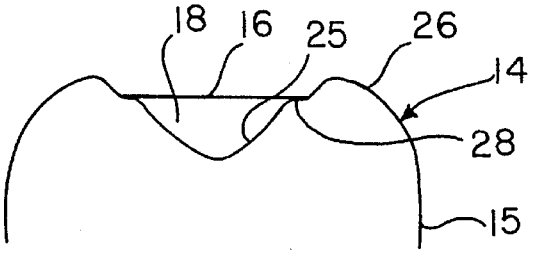

FIG. 3*b* shows another execution form in which the cavity 25 has a ledge or rim 28 running around its circumference, onto which the foil 16 is glued. This execution form has the advantage that a greater portion of the product component can be emptied out before the reactive component is activated, which also reduces the amount of the reactive component required. The ledge 28 within the cavity 25 can be placed higher or lower in the cavity 25, depending on the shape of the can dome and the amount of the reactive component required.

Figure 3C:
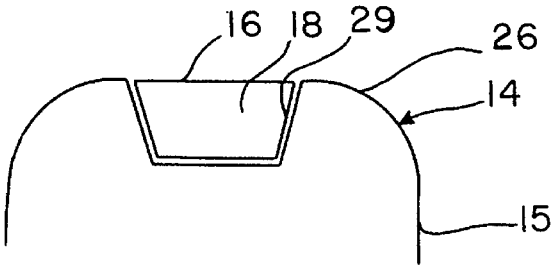

FIG. 3*c* shows a third variation in which the sealing foil 16 is combined with a lining 29 of the cavity 25 to form a pouch. The pouch is fitted into the cavity 25, by mechanical means, for instance—using ledges—or by adhesion. The variation allows for individual placement of the reactive component into the plunger 14. It also makes it possible to use water as the reactive component in a plunger made from polyethylene and propylene, if the pouch is made of aluminum foil, which is impermeable for water.

I claim:

1. A pressurized can for the expulsion of building foams comprising a body, which includes:
- a cylinder;
- a pushed-in bottom;
- a dome-like top section with a valve to expel the can contents comprised of a product component and a propellant;
- a floating plunger mounted on an interior wall of the cylinder which separates a propellant gas chamber from the product component and which includes a cavity in an upper side wherein a reactive component which is reactive with the product component is sealed off from the product component by a seal; and
- a trigger device placed in the dome-like top section which opens the seal when the plunger reaches a position immediately below the dome-like top section.

2. A pressurized can according to claim 1, wherein the trigger device is a spike.

3. A pressurized can according to claim 1, wherein the trigger device is placed on the underside of a valve disk.

4. A pressurized can according to claims 1, 2 or 3, wherein the seal is a foil.

5. A pressurized can according to claims 1, 2 or 3, wherein the seal is made of polyethylene, polypropylene or aluminum.

6. A pressurized can according to claims 1, 2 or 3, wherein the seal is made of aluminum, and the cavity is lined with aluminum foil, such that the seal and the lining are combined with each other.

7. A pressurized can according to claims 1, 2 or 3, wherein the reactive component in the cavity is available in a quantity sufficient to convert the product component remaining in the pressurized can after the plunger strikes up against the dome-like top section into environmentally and/or toxicologically harmless byproducts.

8. A pressurized can according to claims 1, 2 or 3, wherein the reactive component is an OH-reactive substance.

9. A pressurized can according to claims 1, 2 or 3, wherein the reactive component comprises a catalytically active substance.

10. A pressurized can according to claims 1, 2 or 3, wherein the product component is a prepolymer on isocyanate basis.

11. A pressurized can according to claims 1, 2 or 3, wherein reactive component comprises a substance selected from the group consisting of water, a polyvalent alcohol or a mixture thereof in combination with a catalytically active substance to accelerate the reaction.

12. A pressurized can according to claim 1, wherein the reactive component is an OH-reactive substance.

13. A pressurized can according to claim 1, wherein the reactive component is selected from the group consisting of water, a monovalent alcohol, a polyvalent alcohol, a carbonic acid or a mixture thereof.

14. A pressurized can according to claim 1, wherein the reactive component is selected from the group consisting of a monovalent primary amine, a polyvalent primary amine, a monovalent secondary amine or a polyvalent secondary amine.

15. A pressurized can according to claim 1, wherein the reactive component comprises a substance selected from the group consisting of a monovalent tertiary amine, a polyvalent tertiary amine or a metal alkanoate.

16. A pressurized can according to claim 1, wherein the reactive component comprises a pirk catalyzer.

* * * * *